US009531129B2

(12) United States Patent
de Boer

(10) Patent No.: US 9,531,129 B2
(45) Date of Patent: Dec. 27, 2016

(54) ELECTRICAL CONNECTOR AND CONNECTOR SYSTEM HAVING BUSSED GROUND CONDUCTORS

(71) Applicant: Tyco Electronics Corporation, Berwyn, PA (US)

(72) Inventor: Thomas Taake de Boer, Hummelstown, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 48 days.

(21) Appl. No.: 14/709,806

(22) Filed: May 12, 2015

(65) Prior Publication Data

US 2016/0336691 A1 Nov. 17, 2016

(51) Int. Cl.
*H01R 13/648* (2006.01)
*H01R 13/6471* (2011.01)
*H01R 13/6585* (2011.01)

(52) U.S. Cl.
CPC ..... *H01R 13/6471* (2013.01); *H01R 13/6585* (2013.01)

(58) Field of Classification Search
CPC ..... H01R 23/688; H01R 23/6873; H01R 23/7073; H01R 13/514; H01R 13/65802
USPC ..... 439/108, 607.01
See application file for complete search history.

(56) References Cited

U.S. PATENT DOCUMENTS 6,786,771 B2 9/2004 Gailus
7,163,421 B1 * 1/2007 Cohen ..... H01R 13/514 439/108
7,335,063 B2 2/2008 Cohen et al.
7,371,117 B2 5/2008 Gailus
7,581,990 B2 9/2009 Kirk et al.
7,722,401 B2 5/2010 Kirk et al.
7,753,731 B2 7/2010 Cohen et al.
7,771,233 B2 8/2010 Gailus
8,177,564 B1 5/2012 Ito et al.
8,267,721 B2 * 9/2012 Minich ..... H01R 12/724 439/607.05
8,480,413 B2 * 7/2013 Minich ..... H01R 12/724 439/607.05
8,523,583 B2 9/2013 Ito
8,764,464 B2 7/2014 Buck et al.
8,888,529 B2 * 11/2014 Buck ..... H01R 13/6586 439/607.05
2005/0181673 A1 * 8/2005 D'Ambrosia ..... H01R 23/688 439/607.15
2014/0127946 A1 5/2014 Ito et al.

* cited by examiner

*Primary Examiner* — Hien Vu

(57) ABSTRACT

An electrical connector includes a housing having a terminating side and a front side that is configured to mate with a mating connector. The electrical connector also includes signal and ground conductors extending through the housing. The signal and ground conductors are configured to engage the mating connector. The signal conductors form a plurality of signal pairs configured to carry differential signals. The ground conductors are interleaved between the signal pairs. The electrical connector further has at least one resonance-control ground bus that includes a ground frame and a support body. The support body at least partially covers the ground frame. The support body comprises a lossy material. The ground frame includes multiple arms that each engage and electrically connect to a respective one of the ground conductors in order to electrically common the ground conductors that are engaged by the arms.

19 Claims, 6 Drawing Sheets

ELECTRICAL CONNECTOR AND CONNECTOR SYSTEM HAVING BUSSED GROUND CONDUCTORS

BACKGROUND OF THE INVENTION

The subject matter herein relates generally to electrical connectors that have electrically commoned ground conductors.

Communication systems exist today that utilize electrical connectors to transmit data. For example, network systems, servers, data centers, and the like may use numerous electrical connectors to interconnect the various devices of the communication system. Many electrical connectors include signal conductors and ground conductors in which the signal conductors convey data signals and the ground conductors reduce crosstalk and/or electromagnetic interference (EMI) between the signal conductors. In differential signaling applications, the signal conductors are arranged in signal pairs for carrying the data signals. Each signal pair may be separated from an adjacent signal pair by one or more ground conductors.

There has been a general demand to increase the density of signal conductors within the electrical connectors and/or increase the speeds at which data is transmitted through the electrical connectors. As data rates increase and/or distances between the signal conductors decrease, however, it becomes more challenging to maintain a baseline level of signal integrity. For example, in some cases, electrical energy that flows through (for example, on the surface of) each ground conductor of the electrical connector may be reflected and resonate within cavities formed between ground conductors. Unwanted electrical energy, such as EMI, may be supported between nearby ground conductors. Depending on the frequency of the data transmission, electrical noise may develop that increases return loss and/or crosstalk and reduces throughput of the electrical connector.

Accordingly, there is a need for electrical connectors that reduce the electrical noise and interference caused by resonating conditions between ground conductors.

BRIEF DESCRIPTION OF THE INVENTION

In an embodiment, an electrical connector is provided that includes a housing having a terminating side and a front side that is configured to mate with a mating connector. The electrical connector also includes signal and ground conductors extending through the housing. The signal and ground conductors are configured to engage the mating connector. The signal conductors form a plurality of signal pairs configured to carry differential signals. The ground conductors are interleaved between the signal pairs. The electrical connector further has at least one resonance-control ground bus that includes a ground frame and a support body. The support body at least partially covers the ground frame. The support body comprises an electrically lossy material. The ground frame includes multiple arms that are each configured to engage and electrically connect to one of the ground conductors in order to electrically common the ground conductors that are engaged by the arms.

In another embodiment, a connector system includes an electrical plug connector and an electrical receptacle connector. The plug connector includes a plug housing and at least one plug conductor array of signal conductors and ground conductors held in the plug housing. The receptacle connector includes a receptacle housing and at least one receptacle conductor array of signal conductors and ground conductors held in the receptacle housing. The receptacle housing defines a slot at a front end thereof that is configured to receive a mating end of the plug connector to mate the receptacle connector and the plug connector. The receptacle conductor array is configured to engage the plug conductor array within the slot. The signal conductors of the plug conductor array and the receptacle conductor array form a plurality of signal pairs configured to carry differential signals. The ground conductors of the plug conductor array and the receptacle conductor array are interleaved between the signal pairs of the corresponding signal conductors. The plug connector and the receptacle connector each include at least one resonance-control ground bus. Each resonance-control ground bus includes a ground frame and a support body. The support body comprises a lossy material that at least partially covers the ground frame. The ground frame has multiple arms that each are configured to engage and electrically connect to one of the corresponding ground conductors of the respective plug conductor array or receptacle conductor array in order to electrically common the ground conductors that are engaged by the arms.

DETAILED DESCRIPTION OF THE INVENTION

Embodiments set forth herein may include various electrical connectors of a connector system that are configured for communicating data signals. The electrical connectors may mate with a corresponding mating connector to communicatively interconnect different components of a communication system. In various embodiments, the electrical connectors are particularly suitable for high-speed communication systems, such as network systems, servers, data centers, and the like, in which the data rates may be greater than 5 gigabits/second (Gbps). However, one or more embodiments may also be suitable for data rates less than 5 Gbps. In an alternative embodiment, the connector system may include an electrical connector that is configured to mate directly to a card edge of a printed circuit board, instead of connecting directly to a mating connector.

The electrical connectors include signal and ground conductors that are positioned relative to each other to form a pattern or array. The signal and ground conductors of a single array may be substantially co-planar along a row. The signal conductors form signal pairs in which each signal pair is flanked on both sides by at least one ground conductor.

The ground conductors electrically separate the signal pairs to reduce electromagnetic interference or crosstalk and to provide a reliable ground return path. The signal and ground conductors in a single row are patterned to form multiple sub-arrays. Each sub-array includes, in order, a ground conductor, a signal conductor, another signal conductor, and another ground conductor. This arrangement is referred to as a ground-signal-signal-ground (or GSSG) sub-array. The sub-array may be repeated such that a row of conductors may form G-S-S-G-G-S-S-G-G-S-S-G, wherein two ground conductors are positioned between two adjacent signal pairs. In another embodiment, however, adjacent signal pairs share a ground conductor such that the pattern forms G-S-S-G-S-S-G-S-S-G. In both examples above, the sub-array is referred to as a GSSG sub-array. More specifically, the term "GSSG sub-array" includes sub-arrays that share one or more intervening ground conductors that are interleaved between adjacent signal pairs.

Figure 1:
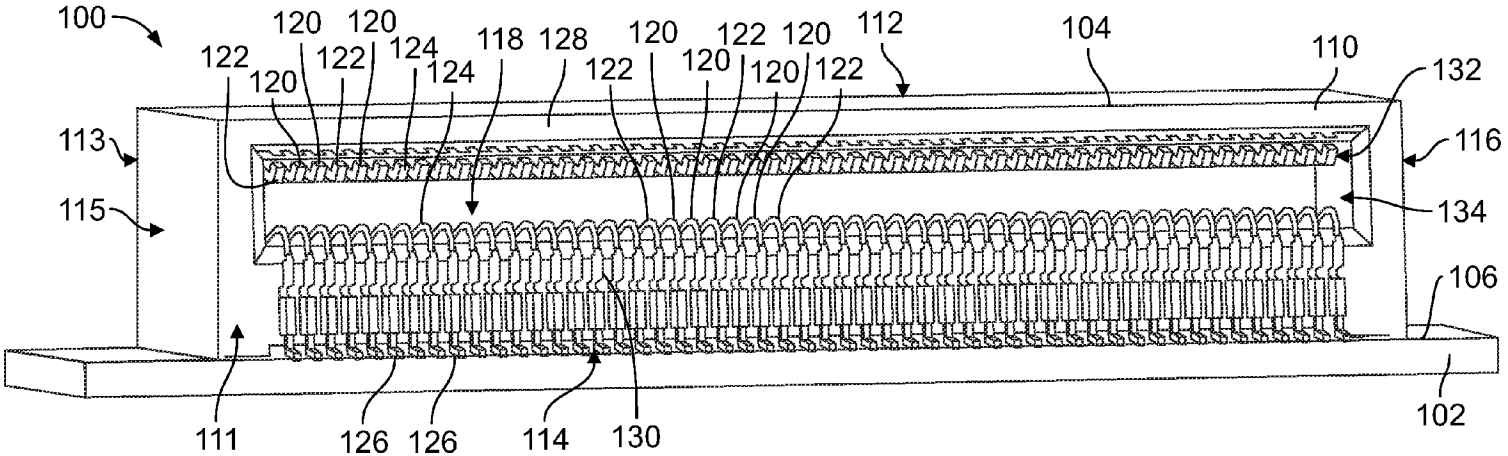
FIG. 1 is a perspective view of a portion of a circuit board assembly formed in accordance with an embodiment.

FIG. 1 is a perspective view of a portion of a circuit board assembly 100 formed in accordance with an embodiment. The circuit board assembly 100 includes a circuit board 102 and an electrical connector 104 that is mounted onto a board surface 106 of the circuit board 102.

In some embodiments, the circuit board assembly 100 may be a daughter card assembly that is configured to engage a backplane or midplane communication system (not shown). In other embodiments, the circuit board assembly 100 may include a plurality of the electrical connectors 104 mounted to the circuit board 102 along an edge of the circuit board 102 in which each of the electrical connectors 104 is configured to engage a corresponding pluggable input/output (I/O) mating connector. The mating plug connector 108 shown in FIG. 2 may be an I/O connector. The electrical connector 104 and pluggable I/O connector may be configured to satisfy certain industry standards, such as, but not limited to, the small-form factor pluggable (SFP) standard, enhanced SFP (SFP+) standard, quad SFP (QSFP) standard, C form-factor pluggable (CFP) standard, and 10 Gigabit SFP standard, which is often referred to as the XFP standard. In some embodiments, the pluggable I/O connector may be configured to be compliant with a small form factor (SFF) specification, such as SFF-8644 and SFF-8449 HD. The electrical connector 104 may be a high-speed electrical connector that is capable of transmitting data at a rate of at least about five (5) gigabits per second (Gbps), at least about 10 Gbps, at least about 20 Gbps, at least about 40 Gbps, or more. Although not shown, the electrical connector 104 optionally may be positioned within a receptacle cage. The receptacle cage may be configured to receive one pluggable I/O connector during a mating operation and direct the pluggable I/O connector toward the electrical connector 104. The circuit board assembly 100 may also include other devices that are communicatively coupled to the electrical connector 104 through the circuit board 102. The electrical connector 104 may be located proximate to an edge of the circuit board 102.

The electrical connector 104 includes a connector housing 110 having a plurality of housing sides. The housing sides include a front side 111, a top side 112, a back side 113, and a terminating side 114. First and second sides 115, 116 extend between the back side 113 and the front side 111. As used herein, relative or spatial terms such as "front," "rear," "top," "bottom," "first," and "second" are only used to distinguish the referenced elements and do not necessarily require particular positions or orientations in the electrical connector 104 relative to gravity or relative to the surrounding environment of the electrical connector 104. The top side 112 faces away from the circuit board 102 and may have the greatest elevation of the housing sides with respect to the board surface 106. The front side 111 is configured to mate with a mating electrical connector, such as the mating plug connector 108 shown in FIG. 2. The terminating side 114 is configured to be mounted to the board surface 106.

In the illustrated embodiment of FIG. 1, the electrical connector 104 is a right-angle connector such that the front side 111 and the terminating side 114 are oriented substantially perpendicular or orthogonal to each other. More specifically, the front side 111 faces in a direction that is substantially perpendicular or orthogonal to the direction that the terminating side 114 faces. In other embodiments, the front side 111 and the terminating side 114 may face in different directions than those shown in FIG. 1. For example, the front side 111 and the terminating side 114 may face in opposite directions, such that the terminating side 114 is located where the back side 113 is located in FIG. 1.

Figure 2:
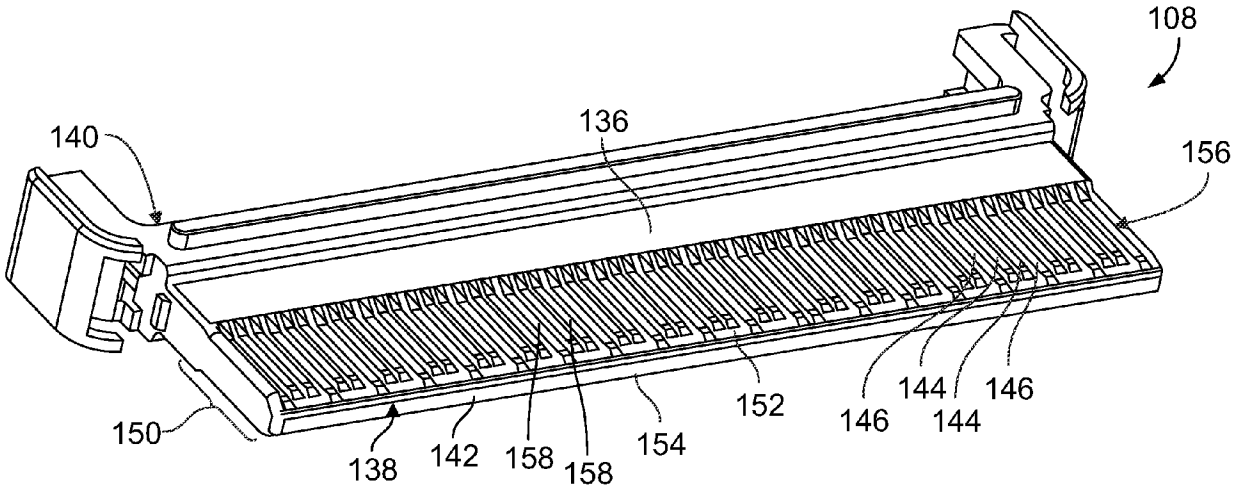
FIG. 2 is a perspective view of an electrical connector that is configured to mate with an electrical connector of the circuit board assembly according to an embodiment.

The connector housing 110 includes a slot 118 along the front side 111 that is sized and shaped to define a socket that receives a portion of the mating connector, such as the plug connector 108 (shown in FIG. 2). For example, in the illustrated embodiment, the slot 118 is sized and shaped to receive a mating end 142 (shown in FIG. 2) of the mating plug connector 108 to mate the receptacle connector 104 and the plug connector 108. In an alternative embodiment, the slot 118 may be configured to receive a circuit board of the mating connector, where the circuit board includes one or more rows of contact pads located along a leading edge of the circuit board. As used herein, the electrical connector 104 is referred to as a "receptacle connector 104," and the connector housing 110 is referred to as a "receptacle housing 110."

The receptacle connector 104 includes signal conductors 120 and ground conductors 122 that are held in the receptacle housing 110 and extend through the receptacle housing 110 between the front side 111 and the terminating side 114. Each of the signal and ground conductors 120, 122 may extend between a mating interface 124 and a terminating end 126. The mating interfaces 124 are configured to slidably engage corresponding conductors of the mating connector, and the terminating ends 126 are configured to engage the circuit board 102. For example, the terminating ends 126 in the illustrated embodiment may be soldered or welded to traces or contact pads (not shown) along the board surface 106. Alternatively, the terminating ends 126 may form compliant pins that are inserted into plated thru-holes (PTHs) (not shown) of the circuit board 102.

In an embodiment, the signal conductors 120 are arranged to form a plurality of signal pairs that are configured to carry differential signals. The ground conductors 122 are interleaved between the signal pairs of signal conductors 120. For example, the signal and ground conductors 120, 122 may be arranged in a plurality of ground-signal-signal-ground (GSSG) sub-arrays in which each pair of signal conductors 120 is located between two ground conductors 122. The signal pair in each GSSG sub-array is disposed between first and second ground conductors 122 that separate the corresponding signal pair from adjacent signal pairs.

The receptacle housing 110 includes a top wall 128 and a bottom wall 130. The top wall 128 defines an upper portion of the slot 118, and the bottom wall 130 defines a lower portion of the slot 118. The top wall 128 extends from the slot 118 at least towards the top side 112 of the housing 110. The bottom wall 130 extends from the slot 118 at least towards the bottom terminating side 114 of the housing 110. In the illustrated embodiment, the signal conductors 120 and the ground conductors 122 of the receptacle connector 104 are arranged in at least one receptacle conductor array. The signal and ground conductors 120, 122 in a common conductor array may be substantially co-planar along a row. Each conductor array includes a plurality of GSSG sub-arrays. The receptacle connector 104 may include a first receptacle conductor array 132 and a second receptacle conductor array 134. A portion of the first receptacle conductor array 132 is disposed along the top wall 128, and a portion of the second receptacle conductor array 134 is disposed along the bottom wall 130. For example, the portions of the signal conductors 120 and the ground conductors 122 of the first and second arrays 132, 134 that are disposed along the corresponding top and bottom walls 128, 130 include the mating interfaces 124.

FIG. 2 is a perspective view of an electrical connector 108 according to an embodiment. The electrical connector 108 is configured to mate with a mating connector, such as the electrical receptacle connector 104 shown in FIG. 1. It is recognized that although the electrical connector 108 is described below as being mated to the receptacle connector 104, in other embodiments the electrical connector 108 may mate with a mating connector other than the receptacle connector 104. The electrical connector 108 is pluggable into the slot 118 (shown in FIG. 1) of the receptacle connector 104. As used herein, the electrical connector 108 is referred to as "plug connector 108." The plug connector 108 and the receptacle connector 104 together define a connector system 170 (shown in FIG. 3) that provides an electrically conductive signal path across the connectors 104, 108 when mated. In the illustrated embodiment, the plug connector 108 is an I/O connector that is configured to be terminated to one or more electrical cables, a circuit card, or the like (not shown). Like the receptacle connector 104, the plug connector 108 may be a high-speed electrical connector that is capable of transmitting data at a rate of at least about five (5) gigabits per second (Gbps), at least about 10 Gbps, at least about 20 Gbps, at least about 40 Gbps, or faster.

The plug connector 108 includes a plug housing 136 that has a front side 138 and a terminating side 140. The front side 138 defines a mating end 142 that is configured to be received in the slot 118 (shown in FIG. 1) of the receptacle connector 104 (FIG. 1). The terminating side 140 in the illustrated embodiment faces in an opposite direction from the front side 138. The terminating side 140 may be configured to terminate to an electrical cable (not shown), such that the cable extends from the terminating side 140 of the plug connector 108. Alternatively, the terminating side 140 may terminate to a circuit card or the like. The plug housing 136 holds signal conductors 144 and ground conductors 146 of the plug connector 108.

The signal conductors 144 and the ground conductors 146 of the plug connector 108 may be arranged similar to the signal conductors 120 and the ground conductors 122, respectively, of the receptacle connector 104 (shown in FIG. 1). For example, the signal and ground conductors 144, 146 of the plug connector 108 may be arranged in at least one plug conductor array that includes a plurality of GSSG sub-arrays along a row. In the illustrated embodiment, the plug housing 136 includes a front tray 150 that extends to the mating end 142. The front tray 150 has a first outer surface 152 and a second outer surface 154. In the illustrated orientation of the plug connector 108, the first outer surface 152 faces upwards and is visible, and the second outer surface 154 faces downwards and is not visible. A first plug conductor array 156 of signal conductors 144 and ground conductors 146 is disposed at least partially along the first outer surface 152. For example, the signal conductors 144 and the ground conductors 146 in the first plug conductor array 156 are arranged in repeating GSSG sub-arrays across a lateral width of the front tray 150.

Mating portions 158 of the signal and ground conductors 144, 146 are exposed on the outer surface 152. As the front tray 150 of the plug connector 108 is loaded into the slot 118 (shown in FIG. 1) of the receptacle connector 104, the exposed mating portions 158 of the signal conductors 144 and the ground conductors 146 are configured to engage and electrically connect with corresponding signal conductors 120 and ground conductors 122, respectively, of the receptacle connector 104. Although not shown in FIG. 2, the plug connector 108 also includes a second plug conductor array 160 (shown in FIG. 3) that is disposed at least partially along the second outer surface 154.

Figure 3:
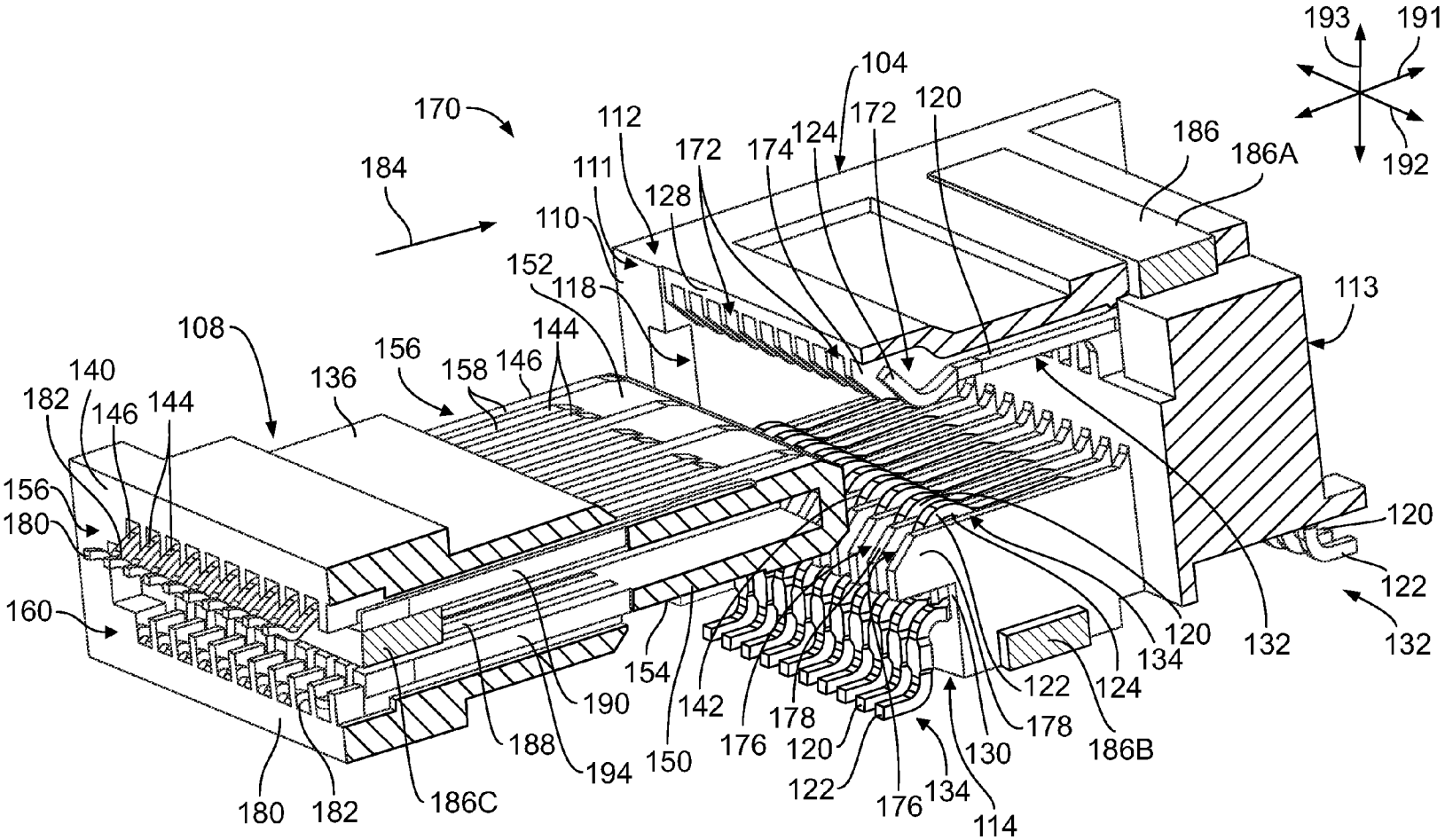
FIG. 3 is a top perspective cutaway view of a connector system formed in accordance with an embodiment.

FIG. 3 is a top perspective cutaway view of a connector system 170 formed in accordance with an embodiment. The connector system 170 includes the receptacle connector 104 shown in FIG. 1 and the plug connector 108 shown in FIG. 2. The plug connector 108 is poised for mating with the receptacle connector 104 in FIG. 3. The connector system 170 is oriented with respect to mutually perpendicular axes, including a mating axis 191, a lateral axis 192, and a vertical or mounting axis 193. In FIG. 3, the vertical axis 193 extends parallel to a gravitational force direction. It should be understood, however, that embodiments described herein are not limited to having a particular orientation with respect to gravity.

The receptacle housing 110 may be molded from a dielectric material. In the illustrated embodiment, the top wall 128 of the receptacle housing 110 that defines an upper boundary of the slot 118 includes a plurality of conductor cavities 172 that open to the slot 118. The conductor cavities 172 are aligned with and configured to receive corresponding signal conductors 120 and ground conductors 122 of the first receptacle conductor array 132. Each conductor cavity 172 may accommodate a corresponding portion of one signal conductor 120 or one ground conductor 122 that includes the mating interface 124. The conductor cavities 172 extend lengthwise along the mating axis 191. The conductor cavities 172 provide space for the signal and ground conductors 122 to deflect upwards away from the slot 118 when engaging the plug connector 108. Adjacent conductor cavities 172 are separated by a divider wall 174. The divider walls 174 along the top wall 128 extend between the signal and ground conductors 120, 122 and prohibit adjacent conductors 120, 122 from engaging one other, such as when the plug connector 108 is being loaded or unloaded relative to the slot 118. In an embodiment, the bottom wall 130 of the receptacle housing 110 also includes a plurality of conductor cavities 176 that open to the slot 118. The conductor cavities 176 may be similar to the conductor cavities 172 of the top wall 128. The conductor cavities 176 are each configured to receive the signal conductors 120 and the ground conductors 122 of the second receptacle conductor array 134. The conductor cavities 176 in the bottom wall 130 are separated by divider walls 178.

The plug housing 136 may be molded from a dielectric material. The plug connector 108 includes the first plug conductor array 156 and a second plug conductor array 160. The mating portions 158 of the signal and ground conductors 144, 146 in the first array 156 are exposed along the first outer surface 152 of the plug housing 136. Likewise, although not shown in FIG. 3, the mating portions 158 of the signal and ground conductors 144, 146 in the second array 160 are exposed along the second outer surface 154. The signal and ground conductors 144, 146 have terminating ends 180 that are disposed proximate to, and may extend from, the terminating side 140 of the plug connector 108. The terminating ends 180 are configured to electrically connect to conductors of an electrical component, such as a wire, a cable, a circuit card, or the like. The terminating ends 180 may include an engagement interface 182 for electrically connecting to the electrical component. The engagement interface 182 may have a curve, such as an "S" curve. The terminating ends 180 of the conductors 144, 146 in the first array 156 are arranged in a row that extends parallel to the lateral axis 192. The terminating ends 180 of the conductors 144, 146 in the second array 160 are arranged in a different row that also extends parallel to the lateral axis 192.

The plug connector 108 is mated to the receptacle connector 104 by moving the plug connector 108 relative to the receptacle connector 104 in a mating direction 184 and/or by moving the receptacle connector 104 relative to the plug connector 108 in a direction opposite to the mating direction 184. The mating direction 184 is parallel to the mating axis 191. The front tray 150 of the plug connector 108 is received, mating end 142 first, into the slot 118 through the front side 111 of the receptacle connector 104. As shown in FIG. 3, the plug connector 108 may be oriented such that the first outer surface 152 of the front tray 150 faces the top wall 128 of the receptacle connector 104, and the second outer surface 154 faces the bottom wall 130. The signal conductors 144 and the ground conductors 146 of the first plug conductor array 156 are configured to engage and electrically connect to corresponding signal conductors 120 and corresponding ground conductors 122 of the first receptacle conductor array 132. In addition, the signal and ground conductors 144, 146 of the second plug conductor array 160 are configured to engage and electrically connect to corresponding signal and ground conductors 120, 122 of the second receptacle conductor array 134. More specifically, as the front tray 150 is moved in the mating direction 184, the ground conductors 146 of the plug connector 108 engage the mating interfaces 124 of the corresponding ground conductors 122 of the receptacle connector 104. The ground conductors 146 force the ground conductors 122 to at least partially deflect outward, away from the slot 118 towards the top side 112 or the terminating side 114, as the ground conductors 146 slide rearward relative to the ground conductors 122. The mating portions 158 of the ground conductors 146 are longer and extend more proximate to the mating end 142 than the mating portions 158 of the signal conductors 144. Thus, the ground conductors 146 of the plug connector 108 engage the corresponding ground conductors 122 of the receptacle connector 104 before the signal conductors 144 of the plug connector 108 engage the corresponding signal conductors 120. Upon further movement of the plug connector 108 in the mating direction 184, the signal conductors 144 engage the mating interfaces 124 of the corresponding signal conductors 120 of the receptacle connector 104, which causes the signal conductors 120 to deflect outward as the signal conductors 144 slide relative to the signal conductors 120. The deflection of the signal conductors 120 and the ground conductors 122 biases the conductors 120, 122 towards the corresponding signal and ground conductors 144, 146 of the plug connector 108 to retain electrical engagement therebetween. The engagement between the corresponding signal conductors 120 and signal conductors 144 provides electrical signal paths between and across the connectors 104, 108. The engagement between the corresponding ground conductors 122 and ground conductors 146 provides electrical shielding between the signal paths and also provides electrical grounding paths between and across the connectors 104, 108.

The plug connector 108 and the receptacle connector 104 each include at least one resonance-control ground bus 186. Each resonance-control ground bus 186 is configured to engage and electrically connect at least two ground conductors 122 of the receptacle connector 104 or at least two ground conductors 146 of the plug connector 108 across one or more pairs of signal conductors 120 or signal conductors 144 to electrically common the at least two ground conductors 122 or 146. Commoning the ground conductors 122 and the ground conductors 146 may reduce electrical interference, such as cross-talk and resonant frequency noise spikes, thereby improving the electrical performance of the mated connectors 104, 108.

In the illustrated embodiment, the receptacle connector 104 includes two resonance-control ground buses 186, a first resonance-control ground bus 186A and a second resonance-control ground bus 186B. The first resonance-control ground bus 186A is disposed proximate to and electrically engages corresponding ground conductors 122 in the first receptacle conductor array 132. The first resonance-control ground bus 186A is located along the top side 112 of the receptacle housing 110 in FIG. 3. In an alternative embodiment, the first resonance-control ground bus 186A or another resonance-control ground bus may be located along the back side 113 of the receptacle housing 110. The first resonance-control ground bus 186A in the illustrated embodiment has a one-piece structure that extends along the lateral axis 192 across multiple GSSG sub-arrays of the first receptacle conductor array 132. For example, the first resonance-control ground bus 186 optionally may extend across all of the GSSG sub-arrays of the first receptacle conductor array 132. Alternatively, the first resonance-control ground bus 186 may extend laterally across only some of the GSSG sub-arrays. The second resonance-control ground bus 186B is disposed proximate to and electrically engages corresponding ground conductors 122 in the second receptacle conductor array 134. The second resonance-control ground bus 186B is located along the terminating side 114 of the receptacle housing 110. In an alternative embodiment, the second resonance-control ground bus 186B or another resonance-control ground bus may be located along the front side 111 of the receptacle housing 110. The second resonance-control ground bus 186B has a one-piece structure that extends across multiple, and optionally all, GSSG sub-arrays of the second receptacle conductor array 134. In an alternative embodiment, the first resonance-control ground bus 186A and/or the second resonance-control ground bus 186B may be comprised of multiple discrete components that are loaded onto the housing 110 end to end along the lateral axis 192. Each of these components is configured to engage and electrically common the ground conductors 122 of one or more, but not all, GSSG sub-arrays in the respective receptacle conductor array 132, 134.

The plug connector 108 in the illustrated embodiment includes only one resonance-control ground bus 186C. The resonance-control ground bus 186C is disposed between the first plug conductor array 156 and the second plug conductor array 160. The resonance-control ground bus 186C is configured to engage and electrically connect the ground conductors 146 in the first conductor array 156 and the ground conductors 146 in the second conductor array 160. In an embodiment, the resonance-control ground bus 186C provides a first current path to electrically common the ground conductors 146 in the first conductor array 156 and a second, different current path to electrically common the ground conductors 146 in the second conductor array 160, as described in more detail with reference to FIGS. 4, 6, and 7 below. Optionally, the resonance-control ground bus 186C is located in a gap 188 defined within the plug housing 136 between a first wall 190 and a second wall 194. The first and second walls 190, 194 extend between the terminating side 140 and the mating end 142. The first wall 190 holds the first plug conductor array 156, and the second wall 194 holds the second plug conductor array 160. In the illustrated embodiment, the first wall 190 is located above the second wall 194 along the vertical axis 193. The resonance-control ground bus 186C within the gap 188 is able to engage both the ground conductors 146 of the first conductor array 156 that are above the ground bus 186C and the ground conductors 146 of the second conductor array 160 that are below the ground bus 186C.

Figure 4:
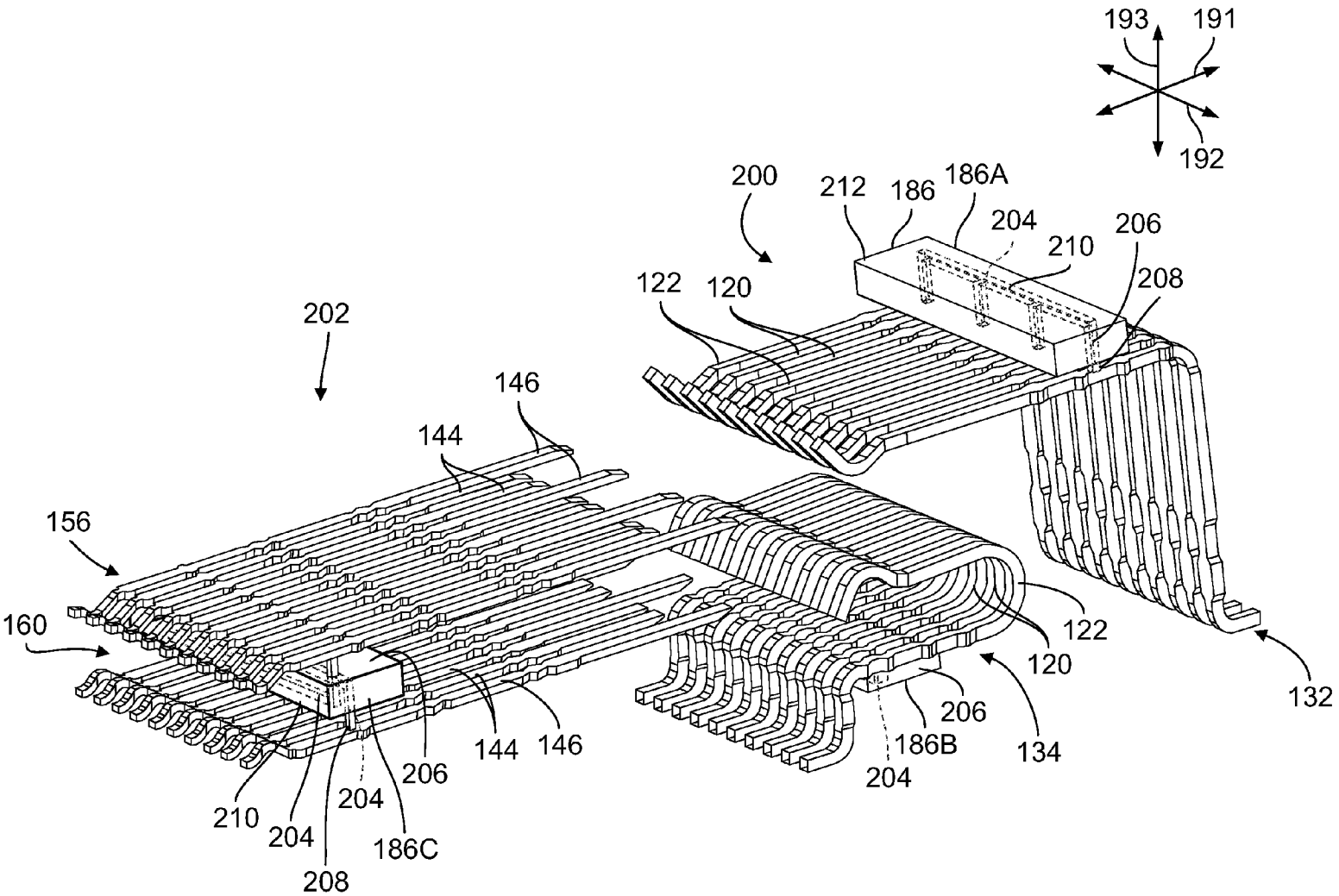
FIG. 4 is a perspective view of a receptacle signal transmission assembly of a receptacle connector and a plug signal transmission assembly of a plug connector according to an embodiment.

FIG. 4 is a perspective view of a receptacle signal transmission assembly 200 of the receptacle connector 104 (shown in FIG. 1) and a plug signal transmission assembly 202 of the plug connector 108 (shown in FIG. 2). The receptacle signal transmission assembly 200 includes the signal conductors 120 and the ground conductors 122 of the first and second receptacle conductor arrays 132, 134. The receptacle signal transmission assembly 200 also includes the resonance-control ground bus 186A and the resonance-control ground bus 186B. Similarly, the plug signal transmission assembly 202 includes the signal conductors 144 and the ground conductors 146 of the first and second plug conductor arrays 156, 160 and the resonance-control ground bus 186C.

In an embodiment, the resonance-control ground buses 186A-186C each include at least one ground frame 204 and an electrically lossy material 206 that engages and at least partially covers the at least one ground frame 204. The following description of one resonance-control ground bus 186 may be representative of one or each of the ground buses 186A-186C. Each ground frame 204 is an electrically conductive member or structure having multiple arms 208 that are each configured to engage and electrically connect to a corresponding ground conductor 122 of the receptacle signal transmission assembly 200 or a corresponding ground conductor 146 of the plug signal transmission assembly 202. The arms 208 extend from a bridge 210 of the ground frame 204. The bridge 210 is oriented transverse to the respective ground conductors 122, 146 such that the bridge 210 extends across multiple ground conductors 122, 146. The bridge 210 is spaced apart from the respective ground conductors 122, 146 such that the bridge 210 does not directly engage the ground conductors 122, 146 or the corresponding signal conductors 120, 144 disposed between the ground conductors 122, 146, respectively. The arms 208 extend from the bridge 210 at spaced-apart locations along a length of the bridge 210. The ground frame 204 is configured to provide an electrical current path between the corresponding ground conductors 122 or ground conductors 146 that are engaged by the arms 208 of that ground frame 204 to electrically common those ground conductors 122 or ground conductors 146. The current path extends through the arms 208 and the bridge 210.

In FIG. 4, the signal conductors 120 and the ground conductors 122 of the receptacle signal transmission assembly 200 and the signal conductors 144 and the ground conductors 146 of the plug signal transmission assembly 202 are oriented generally along the mating axis 191. The ground frames 204 extend generally along the lateral axis 192 across the respective GSSG sub-arrays. The bridges 210 are spaced vertically apart from the corresponding GSSG sub-arrays. The arms 208 extend generally along the vertical axis 193 between the respective bridges 210 and the corresponding ground conductors 122, 146. In other embodiments, the ground frames 204 may extend transverse to the GSSG sub-arrays at angles other than perpendicular or orthogonal angles. In addition, the arms 208 may extend from the bridges 210 at angles other than perpendicular or orthogonal angles in other embodiments.

The bridge 210 of the ground frame 204 may be encased in a support body 212 that comprises the electrically lossy material 206, referred to herein as "lossy material 206." The arms 208 of the ground frame 204 may be at least partially covered by the lossy material 206. In an embodiment, the arms 208 protrude from the lossy material 206 of the support body 212 to engage the corresponding ground conductors 122, 146. The support body 212 is spaced apart from and does not directly engage the corresponding ground conductors 122, 146 or the corresponding signal conductors 120, 144. Thus, the lossy material 206 of the support body 212 may indirectly engage the corresponding ground conductors 122, 146 via the ground frame 204. The lossy material 206, as described in more detail below, is configured to absorb at least some electrical resonance that propagates along the current path defined by the ground frame 204 and/or at least some electrical resonance that propagates along the signal path defined by the corresponding signal conductors 120, 144.

Figure 5:
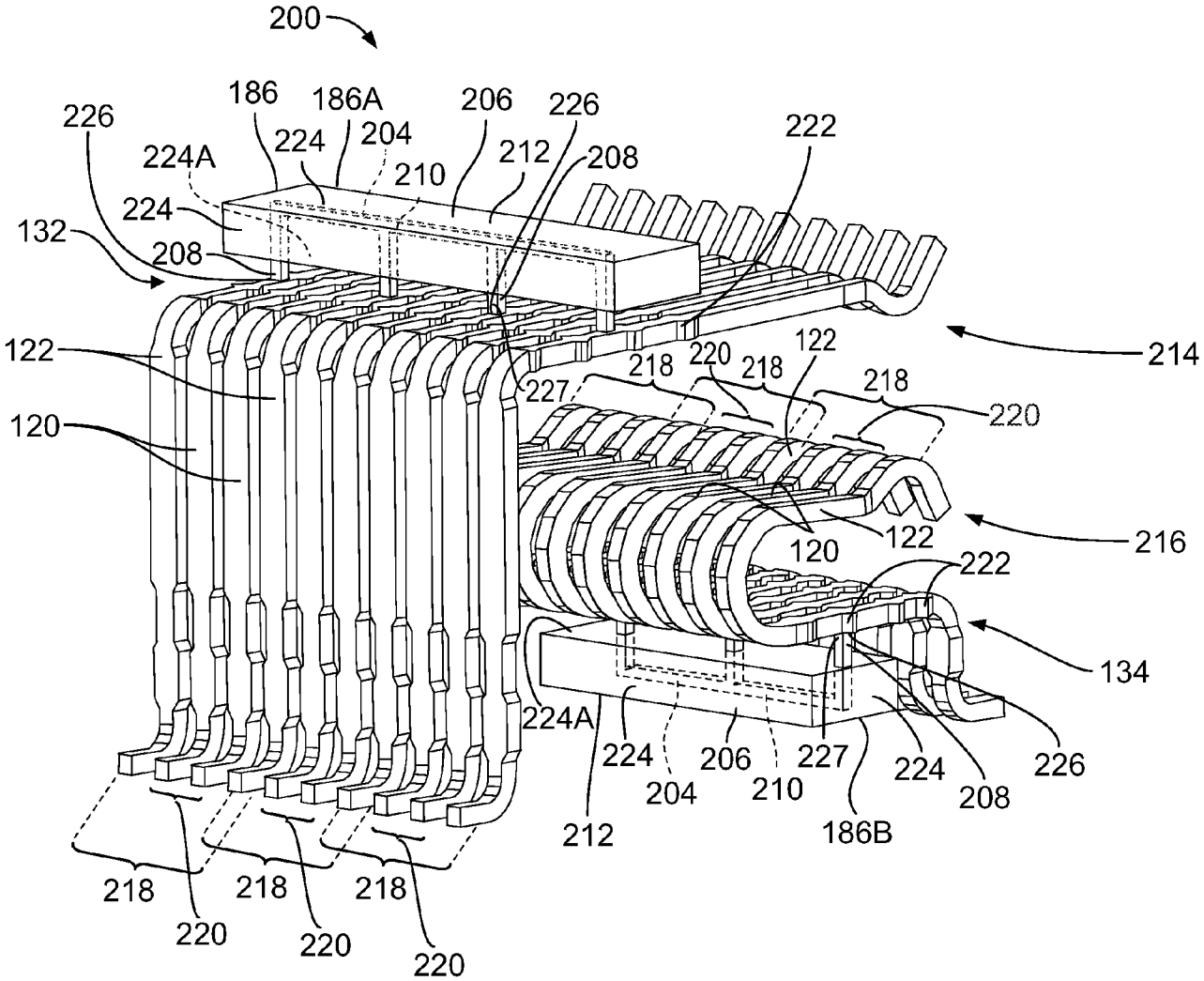
FIG. 5 is a rear perspective view of the receptacle signal transmission assembly according to an embodiment.

FIG. 5 is a rear perspective view of the receptacle signal transmission assembly 200 according to an embodiment. The signal conductors 120 and ground conductors 122 in the first receptacle conductor array 132 form a first conductor row 214. The signal and ground conductors 120, 122 of the first conductor row 214 may have identical or substantially identical shapes. For example, the signal and ground conductors 120, 122 may be stamped and formed from sheet metal using a common press. The signal and ground conductors 120, 122 are formed of a conductive metal material such as copper or a copper alloy, silver, or the like, that is capable of transmitting data signals at a commercially desirable data rate. Similarly, the signal conductors 120 and ground conductors 122 in the second receptacle conductor array 134 form a second conductor row 216. The signal and ground conductors 120, 122 of the second conductor row 216 may have identical or substantially identical shapes as one another, and may be stamped and formed from sheet metal using a common press.

The signal conductors 120 and the ground conductors 122 are positioned relative to one another to form a plurality of GSSG sub-arrays 218. The signal and ground conductors 120, 122 in the first conductor row 214 and in the second conductor row 216 each form three GSSG sub-arrays 218 in the illustrated embodiment. It should be understood that the first conductor row 214 and/or the second conductor row 216 may include more or less than three GSSG sub-arrays 218. Each of the GSSG sub-arrays 218 includes a corresponding signal pair 220 of signal conductors 120 having two ground conductors 122 on opposite sides of the corresponding signal pair 220. The signal pairs 220 configured to carry differential signals. The ground conductors 122 are positioned relative to the signal pairs 220 to electrically separate adjacent signal pairs 220 from one another. In the illustrated embodiment, adjacent GSSG sub-arrays 218 may share a ground conductor 122, such that two adjacent signal pairs 220 are separated by a single ground conductor 122. In an alternative embodiment, the GSSG sub-arrays 218 may not share a ground conductor 122. In such embodiments, the pattern of the first conductor row 214 and/or the second conductor row 216 may be ground-signal-signal-ground-ground-signal-signal-ground-ground-signal-signal-ground (or G-S-S-G-G-S-S-G-G-S-S-G). Optionally, the signal and ground conductors 120, 122 in the first conductor row 214 and/or in the second conductor row 216 may include interference features 222. The interference features 222 are configured to engage portions of the receptacle housing 110 (shown in FIG. 1) to hold the corresponding conductor 120, 122 relative to the receptacle housing 110.

In an embodiment, the ground frame 204 of the resonance-control ground buses 186 is formed of a conductive metal material, such as copper, silver, a metal alloy such as copper alloy or stainless steel, or the like. The lossy material 206 is able to conduct electrical energy, but with at least some loss. The lossy material 206 is less conductive than the ground frame 204 that the lossy material 206 at least partially covers. The lossy material 206 is also less conductive than the conductive material that forms the signal and ground conductors 120, 122. The lossy material 206 may include conductive particles (or fillers) dispersed within a dielectric (binder) material. The dielectric material, such as a polymer or epoxy, is used as a binder to hold the conductive particle filler elements in place. These conductive particles then impart loss to the lossy material 206. In some embodiments, the lossy material 206 is formed by mixing binder with filler that includes conductive particles. Examples of conductive particles that may be used as a filler to form electrically lossy materials include carbon or graphite formed as fibers, flakes, or other particles. Metal in the form of powder, flakes, fibers, or other conductive particles may also be used to provide suitable lossy properties. Alternatively, combinations of fillers may be used. For example, metal plated (or coated) particles may be used. Silver and nickel may also be used to plate particles. Plated (or coated) particles may be used alone or in combination with other fillers, such as carbon flakes. In some embodiments, the fillers may be present in a sufficient volume percentage to allow conducting paths to be created from particle to particle. For example when metal fiber is used, the fiber may be present at an amount up to 40% by volume or more.

As used herein, the term "binder" encompasses material that encapsulates the filler or is impregnated with the filler. The binder material may be any material that will set, cure, or can otherwise be used to position the filler material. In some embodiments, the binder may be a thermoplastic material such as those traditionally used in the manufacture of electrical connectors. The thermoplastic material may facilitate the molding of the lossy material 206 into the desired shapes and locations. However, many alternative forms of binder materials may be used. Curable materials, such as epoxies, can serve as a binder. Alternatively, materials such as thermosetting resins or adhesives may be used.

The lossy material 206 of the resonance-control ground bus 186 may be affixed to the ground frame 204. In an embodiment, the lossy material 206 is molded onto the ground frame 204. For example the lossy material 206 may be overmolded around the ground frame 204 during a molding process. The shape of the resulting molded support body 212 of the lossy material 206 may be defined by the mold used during the molding process. In another embodiment, the lossy material 206 may be coated or painted onto the ground frame 204 to at least partially surround and cover the ground frame 204 instead of overmolding the lossy material 206 around the ground frame 204.

The support bodies 212 of the lossy material 206 of the first resonance-control ground bus 186A and the second resonance-control ground bus 186B are in the shape of prisms or parallelepipeds. For example, as shown in FIG. 5, the support bodies 212 may be right rectangular prisms or parallelepipeds with six surfaces 224, such that each adjacent surface 224 meets at right angles. The support bodies 212 may have other shapes and/or different numbers of surfaces in other embodiments. The support bodies 212 have a conductor surface 224A that faces the signal conductors 120 and ground conductors 122 of the proximate receptacle conductor array 132, 134. The arms 208 of the ground frame 204 protrude from the conductor surface 224A. Optionally, no parts of the ground frame 204 protrude from any of the other surfaces 224 besides the conductor surface 224A, such that the lossy material 206 encapsulates the ground frame 204 except for the portions of the arms 208 that protrude from the conductor surface 224A. In an alternative embodiment, the arms 208 protrude from one or more surfaces 224 adjacent to the conductor surface 224A in addition to, or instead of protruding from the conductor surface 224A.

The arms 208 of the ground frame 204 each have a distal end 226 that is configured to engage a corresponding ground conductor 122. The arms 208 are designed to retain engagement with the corresponding ground conductors 122 that the arms 208 engage in order to provide a reliable electrical connection. For example, in an embodiment, the arms 208 may be deflectable spring arms that are configured to deflect at least partially in response to a normal force applied on the arms 208 by the corresponding ground conductors 122. The deflection biases the arms 208 to apply a biasing force on the ground conductors 122 to retain engagement between the distal ends 226 of the arms 208 and the ground conductors 122. The distal ends 226 of the arms 208 may be curved or rounded to reduce damage and snagging at the separable interface between the arms 208 and the ground conductors 122. In another embodiment, the arms 208 of the ground frame 204 may each have a pin 227. The pin 227 may taper to the distal end 226 to define a point. The pin 227 may be configured to penetrate the corresponding ground conductor 122, such as by piercing the ground conductor 122 to form a hole or extending through a predefined hole in the ground conductor 122. In another example, the arms 208 each may define a slot (not shown) that extends from the distal end 226 at least partially towards the bridge 210. The slot may be configured to receive the corresponding ground conductor 122 therein. The slot may be defined between two fingers that deflect at least partially as the ground conductor 122 is received in the slot, such that the fingers are biased against the ground conductor 122 to retain the electrical connection between the arm 208 and the ground conductor 122.

As shown in FIG. 5, the first and second resonance-control ground buses 186A, 186B each have a single ground frame 204 within the lossy material 206. But, in other embodiments, more than one ground frame 204 may be held within the lossy material 206 of one or both ground buses 186A, 186B. For example, two ground frames in a common support body of lossy material may be spaced apart along the mating axis 191 (shown in FIG. 4) such that the arms of the two ground frames engage the same ground conductors at two different locations along the length of the ground conductors.

Figure 6:
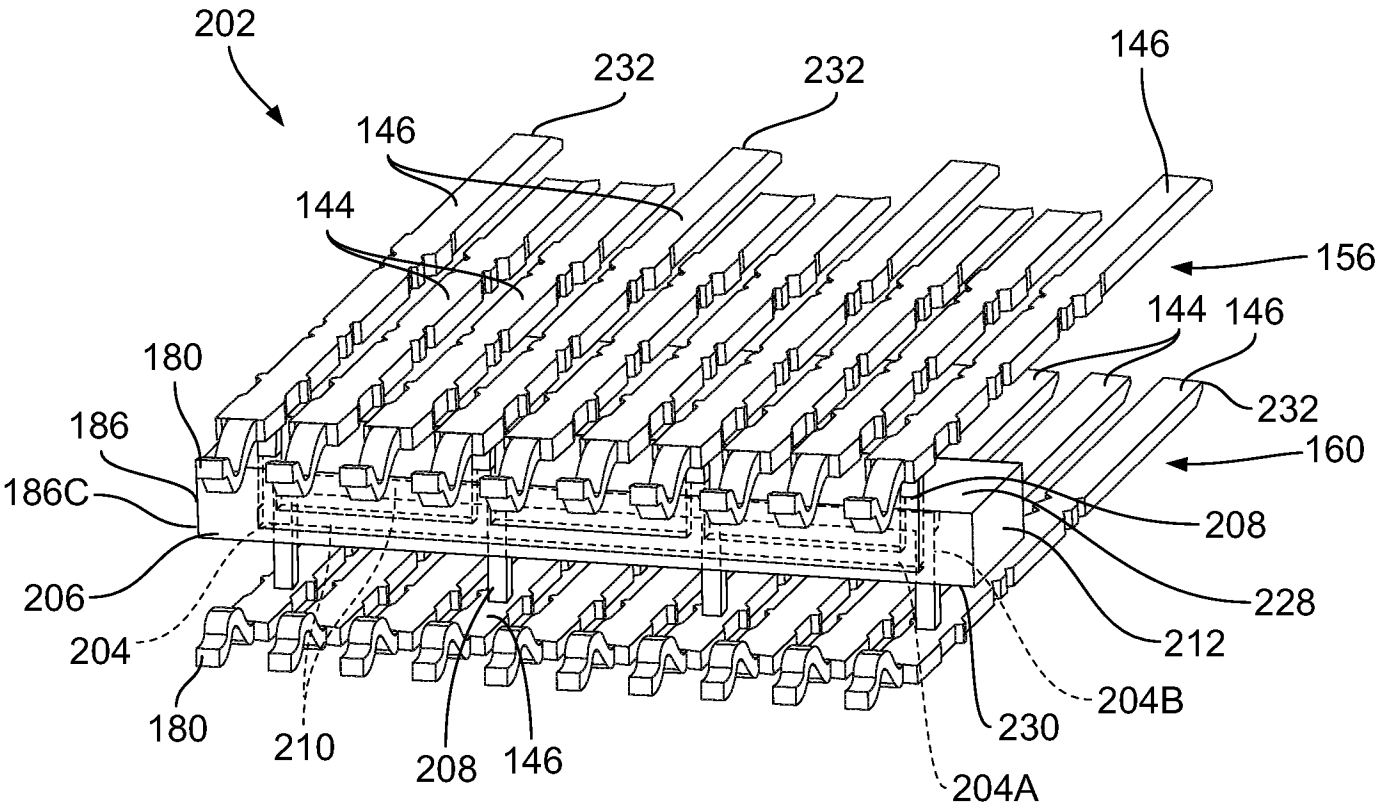
FIG. 6 is a rear perspective view of the plug signal transmission assembly according to an embodiment.

FIG. 6 is a rear perspective view of the plug signal transmission assembly 202 according to an embodiment. The signal conductors 144 and the ground conductors 146 of the plug signal transmission assembly 202 are formed of a conductive metal material, such as copper, a copper alloy, silver, or the like, similar to the signal conductors 120 (shown in FIG. 5) and the ground conductors 122 (FIG. 5) of the receptacle signal transmission assembly 200 (FIG. 5). The lossy material 206 of the resonance-control ground bus 186C may be formed of a dielectric binder material with conductive particles dispersed therein, such that the lossy material 206 is able to conduct electrical energy, but with some loss due to energy that is absorbed by the lossy material 206. The lossy material 206 of the ground bus 186C may be the same or similar to the lossy material 206 of the resonance-control ground buses 186A, 186B shown in FIG. 5.

In the illustrated embodiment, the resonance-control ground bus 186C includes two ground frames 204 that are commonly encased in the lossy material 206. For example, a first ground frame 204A and a second ground frame 204B are both at least partially covered by a single, integral support body 212 defined by the lossy material 206. Each ground frame 204A, 204B may be similar to the ground frames 204 of the resonance-control ground buses 186A, 186B shown in FIG. 5. For example, each ground frame 204A, 204B may be a conductive metal structure that includes a bridge 210 and arms 208 extending from the bridge 210. In the illustrated embodiment, the first ground frame 204A is configured to engage and electrically connect the ground conductors 146 in the first plug conductor array 156. The second ground frame 204B, on the other hand, is configured to engage and electrically connect the ground conductors 146 in the second plug conductor array 160. The ground bus 186C is disposed vertically between the first and second conductor arrays 156, 160, such that the first conductor array 156 is above the ground bus 186C and the second conductor array 160 is below the ground bus 186C in the illustrated orientation. The arms 208 of the first ground frame 204A extend upwards and protrude from a top surface 228 of the support body 212 to engage and electrically connect to the corresponding ground conductors 146 of the plug conductor array 156. Conversely, the arms 208 of the second ground frame 204B extend downwards and protrude from a bottom surface 230 of the support body 212 to engage and electrically connect to the corresponding ground conductors 146 of the plug conductor array 160.

In an embodiment, the first and second ground frames 204A, 204B do not engage each other within the support body 212 of the lossy material 206. For example, in the illustrated embodiment, the first ground frame 204A is more proximate to the terminating ends 180 of the signal and ground conductors 144, 146 than the proximity of the second ground frame 204B to the terminating ends 180. Alternatively, the second ground frame 204B may be closer to the terminating ends 180 than the first ground frame 204A, or the ground frames 204A, 204B may be equidistant from the terminating ends 180 but spaced apart vertically such that the bridges 210 of the ground frames 204A, 204B do not engage one another. Although the arms 208 of the ground frames 204A, 204B engage the corresponding ground conductors 146 more proximate to the terminating ends 180 than to mating ends 232 of the conductors 146 in FIG. 6, the ground bus 186C and/or the ground frames 204A, 204B in the ground bus 186C may be located in other positions relative to the ground conductors 146 in other embodiments, such as depending on impedance and other electrical and mechanical factors. The ground bus 186C may include more or less than the two ground frames 204A, 204B shown in FIG. 6. In an alternative embodiment, the plug signal transmission assembly 202 may include two or more ground buses 186, that each include one or more ground frames 204 at least partially covered by a lossy material 206.

Figure 7:
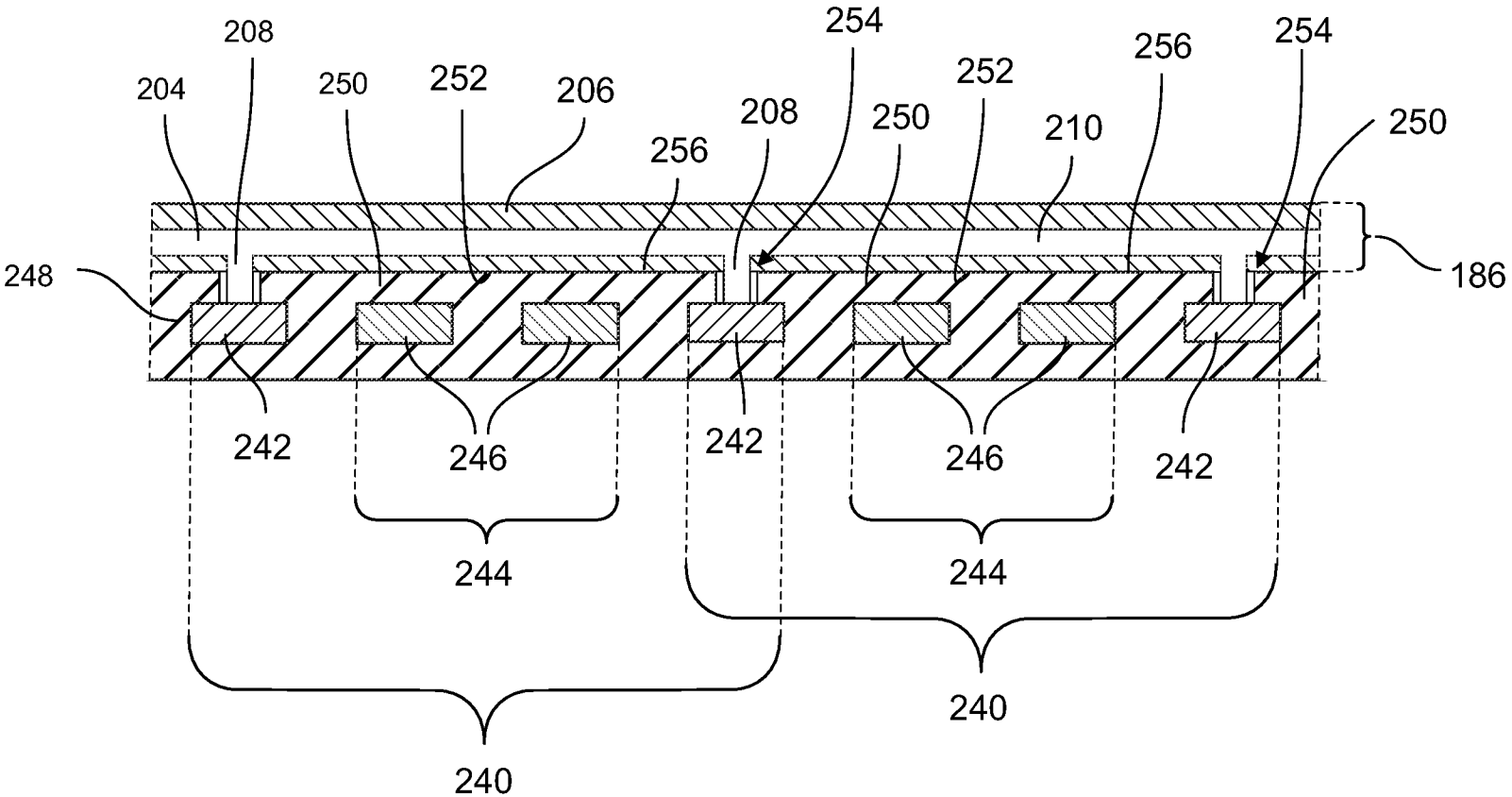
FIG. 7 is a cross-sectional view of a portion of a receptacle connector or a plug connector according to an embodiment.

FIG. 7 is a cross-sectional view of a portion of the receptacle connector 104 shown in FIG. 1 or the plug connector 108 shown in FIG. 2 according to an embodiment. The illustrated portion includes two GSSG sub-arrays 240 that share a ground conductor 242 between the two signal pairs 244 of signal conductors 246. The signal conductors 246 and the ground conductors 242 are held by a housing 248, which may be the receptacle housing 110 (shown in FIG. 1) or the plug housing 136 (shown in FIG. 2). The housing 248 may be overmolded around the signal and ground conductors 246, 242 or may define channels that receive the conductors 246, 242 and hold the conductors 246, 242 in spaced-apart positions. The housing 248 defines platform portions 250 that extend from the signal conductors 246 (or from the channels that receive the signal conductors 246) to outer surfaces 252 of the housing 248. The platform portions 250 are arranged side-by-side in a lateral direction and are separated from one another by channels 254. Each channel 254 extends from the outer surfaces 252 to a corresponding ground conductor 242 and provides access to the ground conductor 242. In an embodiment, the resonance-control ground bus 186 is located on the outer surfaces 252 of the housing 248 such that a conductor surface 256 of the lossy material 206 abuts the outer surfaces 252 of the platform portions 250. The arms 208 of the ground frame 204 protrude from the conductor surface 256 and align with the channels 254. The arms 208 extend through the corresponding channels 254 to engage the corresponding ground conductors 242 within the channels 254. Thus, as shown in FIG. 7, only the arms 208 of the ground frame 204 engage the ground conductors 242. The lossy material 206 does not directly engage the ground conductors 242. Neither the lossy material 206 nor the ground frame 204 engages the signal conductors 246. The platform portions 250 separate the signal conductors 246 from the ground bus 186.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising: a housing having a terminating side and a front side that is configured to mate with a mating connector;

signal and ground conductors extending through the housing, the signal and ground conductors configured to engage the mating connector, the signal conductors forming a plurality of signal pairs configured to carry differential signals, the ground conductors being interleaved between the signal pairs; and at least one resonance-control ground bus including a ground frame and a support body at least partially covering the ground frame, the support body comprising a lossy material, the ground frame including multiple arms that each engage and electrically connect to a respective one of the ground conductors in order to electrically common the ground conductors that are engaged by the arms;

wherein the ground frame provides an electrical current path between the ground conductors engaged by the arms of the ground frame and the lossy material of the support body absorbs at least some electrical resonance that propagates along the current path.

2. The electrical connector of claim 1, wherein the ground frame includes a bridge that is oriented transverse to the ground conductors and is spaced apart from the ground conductors, the bridge being encased in the support body, the arms of the ground frame extending from the bridge at spaced-apart locations along a length of the bridge and protruding from the support body to engage the respective ground conductors.

3. The electrical connector of claim 1, wherein the signal conductors and the ground conductors form a plurality of ground-signal-signal-ground (GSSG) sub-arrays, each GSSG sub-array including a corresponding signal pair disposed between first and second ground conductors that separate the corresponding signal pair from adjacent signal pairs.

4. The electrical connector of claim 1, wherein the arms of the ground frame are deflectable spring arms that are configured to apply a biasing force on the corresponding ground conductors to retain engagement with the corresponding ground conductors.

5. The electrical connector of claim 1, wherein each of the arms of the ground frame has a pin at a distal end thereof that engages the corresponding ground conductor.

6. The electrical connector of claim 1, wherein the support body is spaced apart from and not in direct engagement with the ground conductors, the arms of the ground frame protruding from a surface of the support body to engage the ground conductors such that the lossy material of the support body indirectly engages the ground conductors via the ground frame.

7. The electrical connector of claim 1, wherein the signal conductors and the ground conductors of the electrical connector are arranged in a first array and a second array, the electrical connector including a first resonance-control ground bus disposed proximate to and electrically engaging corresponding ground conductors in the first array and a second resonance-control ground bus disposed proximate to and electrically engaging corresponding ground conductors in the second array.

8. The electrical connector of claim 1, wherein the signal conductors and the ground conductors of the electrical connector are arranged in a first array and a second array, the at least one resonance-control ground bus being disposed between the first array and the second array.

9. The electrical connector of claim 8, wherein the at least one resonance-control ground bus includes two ground frames commonly encased in the lossy material of the support body, a first ground frame of the two ground frames configured to engage and electrically connect the ground conductors in the first array, a second ground frame of the two ground frames being spaced apart from the first ground frame within the support body and configured to engage and electrically connect the ground conductors in the second array.

10. The electrical connector of claim 1, wherein the housing includes platform portions that extend from the signal conductors to outer surfaces of the housing, the platform portions being separated from one another by channels that each provide access to a corresponding ground conductor, the support body of the resonance-control ground bus abutting the outer surfaces of the platform portions, the arms of the resonance-control ground bus extending through the channels to engage the corresponding ground conductors.

11. The electrical connector of claim 1, wherein the lossy material of the support body includes conductive particles dispersed within a dielectric binder material.

12. A connector system comprising:

an electrical plug connector that includes a plug housing and at least one plug conductor array of signal conductors and ground conductors held in the plug housing; and an electrical receptacle connector that includes a receptacle housing and at least one receptacle conductor array of signal conductors and ground conductors held in the receptacle housing, the receptacle housing defining a slot at a front side thereof that is configured to receive a mating end of the plug connector to mate the receptacle connector and the plug connector, the receptacle conductor array configured to engage the plug conductor array within the slot;

wherein the signal conductors of the plug conductor array and the receptacle conductor array form a plurality of signal pairs configured to carry differential signals, and the ground conductors of the plug conductor array and the receptacle conductor array are interleaved between the signal pairs of the corresponding signal conductors; and wherein the plug connector and the receptacle connector each include at least one resonance-control ground bus, each resonance-control ground bus including a ground frame and a support body, the support body comprising a lossy material that at least partially covers the ground frame, the ground frame having multiple arms that each engage and electrically connect to a respective one of the corresponding ground conductors of the respective plug conductor array or receptacle conductor array in order to electrically common the ground conductors that are engaged by the arms;

wherein the ground frame provides an electrical current path between the ground conductors engaged by the arms of the ground frame and the lossy material of the support body absorbs at least some electrical resonance that propagates along the current path.

13. The connector system of claim 12, wherein the ground frame of at least one of the resonance-control ground buses includes a bridge that is oriented transverse to the corresponding ground conductors and is spaced apart from the corresponding ground conductors, the bridge being encased in the lossy material of the support body, the arms of the ground frame extending from the bridge at spaced-apart locations along a length of the bridge and protruding from the support body to engage the corresponding ground conductors.

14. The connector system of claim 12, wherein the at least one receptacle conductor array of the receptacle conductor includes a first array and a second array, at least a portion of the signal conductors and the ground conductors in the first array being disposed along a top wall defining part of the slot and at least a portion of the signal conductors and the ground conductors in the second array being disposed along a bottom wall defining another part of the slot, wherein the receptacle connector includes a first resonance-control ground bus disposed proximate to and electrically engaging the corresponding ground conductors in the first array, and the receptacle connector further includes a second resonance-control ground bus disposed proximate to and electrically engaging the corresponding ground conductors in the second array.

15. The connector system of claim 12, wherein the plug housing of the plug connector includes a front tray that extends to the mating end and is configured to be loaded into the slot of the receptacle connector, the at least one plug conductor array of the plug conductor including a first array that extends along a first side of the front tray and a second array that extends along an opposite, second side of the front tray, the at least one resonance-control ground bus of the plug connector being disposed between the first array and the second array.

16. The connector system of claim 15, wherein the at least one resonance-control ground bus of the plug connector includes two ground frames commonly encased in the lossy material of the support body, a first ground frame of the two ground frames configured to engage and electrically connect the ground conductors in the first array, a second ground frame of the two ground frames being spaced apart from the first ground frame within the support body and configured to engage and electrically connect the ground conductors in the second array.

17. The connector system of claim 12, wherein the support body is spaced apart from and not in direct engagement with the corresponding ground conductors, the arms of the ground frame of the resonance-control ground bus protruding from a surface of the support body to engage the corresponding ground conductors such that the lossy material of the support body indirectly engages the corresponding ground conductors via the ground frame.

18. The connector system of claim 12, wherein the arms of the ground frame of at least one of the resonance-control ground buses are deflectable spring arms that are configured to apply a biasing force on the corresponding ground conductors to retain engagement with the corresponding ground conductors.

19. The connector system of claim 12, wherein each of the arms of the ground frame of at least one of the resonance-control ground buses has a pin at a distal end thereof that engages the corresponding ground conductor.

* * * * *